US006348080B1

(12) United States Patent
Arvidsson et al.

(10) Patent No.: US 6,348,080 B1
(45) Date of Patent: Feb. 19, 2002

(54) STEEL POWDER FOR THE PREPARATION OF SINTERED PRODUCTS

(75) Inventors: Johan Arvidsson, Nyhamnsläge; Ola Eriksson, Höganäs, both of (SE)

(73) Assignee: Höganäs AB, Hoganas (SE)

( * ) Notice: Subject to any disclaimer, the term of this patent is extended or adjusted under 35 U.S.C. 154(b) by 0 days.

(21) Appl. No.: 09/618,939

(22) Filed: Jul. 18, 2000

Related U.S. Application Data

(63) Continuation of application No. PCT/SE99/00092, filed on Jan. 21, 1999.

(30) Foreign Application Priority Data

Jan. 21, 1998 (SE) ..... 9800154

(51) Int. Cl.[7] ..... C22C 1/04

(52) U.S. Cl. ..... 75/246; 75/255; 419/31; 419/38; 419/46; 148/513

(58) Field of Search ..... 419/46, 31, 38; 75/246, 255; 148/513

(56) References Cited

U.S. PATENT DOCUMENTS 4,069,044 A * 1/1978 Mocarski et al. ..... 75/243
4,234,168 A * 11/1980 Kajinaga et al. ..... 266/128
4,266,974 A 5/1981 Nitta et al.
4,382,818 A * 5/1983 Mocarski ..... 419/11

FOREIGN PATENT DOCUMENTS

EP 0653262 5/1995
WO WO 9803291 1/1998

* cited by examiner

*Primary Examiner*—Daniel J. Jenkins
(74) *Attorney, Agent, or Firm*—Burns, Doane, Swecker & Mathis, L.L.P.

(57) ABSTRACT

The present invention concerns a method of preparing a sintered product having a tensile strength 750 MPa comprising the steps of compacting a water-atomised, annealed iron-based powder comprising, by weight %, Cr 2.5–3.5, Mo 0.3–0.7, Mn 0.09–0.3, O <0.2, C<0.01 the balance being iron and, an amount of not more than 1%, inevitable impurities, at a pressure of at least 600 MPa and subjecting the compacted body to sintering at a temperature of at most 1220° C. The invention also concerns the annealed powder used in the method as well as the sintered products.

30 Claims, 1 Drawing Sheet

STEEL POWDER FOR THE PREPARATION OF SINTERED PRODUCTS

This is a continuation of International Application No. PCT/SE99/00092, filed Jan. 21, 1999, that designates the United States of America and claims priority for Swedish Application No. 9800154-8, filed Jan. 21, 1998.

FIELD OF THE INVENTION

The present invention concerns a chromium base alloy steel powder. More specifically the invention concerns a low oxygen, low carbon alloy steel powder including in addition to iron and chromium also Mo and Mn as well as the preparation thereof. The invention also concerns a method of preparing sintered components from this powder as well as the sintered components.

BACKGROUND OF THE INVENTION

There have recently been developed various techniques for strengthening materials for sintered machine parts produced from various alloy steel powders through powder metallurgy. The use of the alloying elements chromium, molybdenum and manganese in low oxygen, low carbon iron powders has been suggested in e.g. the U.S. Pat. No. 4,266,974 and EP 0 653 262. The base material for the powder in both publications is a water atomised and reduction-annealed powder. The US publication discloses that the most important step in order to obtain a powder having low oxygen and carbon contents is the annealing step, which preferably should be performed under reduced pressure, specifically by vacuum induction heating. The U.S. patent also discloses that other methods of reduction annealing involve drawbacks limiting their commercial scale installation. Nothing is disclosed in the EP application about the reduction annealing. The effective amounts of the alloying elements according to the US patent are between 0.2 and 5.0% by weight of chromium, 0.1 and 7.0% by weight of molybdenum and 0.35 and 1.50% by weight of manganese. The EP publication discloses that the effective amounts should be between 0.5 and 3% by weight of chromium, 0.1 and 2% by weight of molybdenum and at most 0.08% by weight of manganese. The purpose of the invention according to the U.S. patent is to provide a powder satisfying the demands of-high compressibility and moldability of the powder and good heat-treatment properties, such as carburising, hardenability, in the sintered body. A serious drawback when using the invention disclosed in the EP application is that cheap scrap cannot be used as this scrap normally includes more than 0.08% by weight of manganese. In this context the EP application teaches that a specific treatment has to be used in order to reduce the Mn content to a level not larger than 0.08% by weight. Another problem is that nothing is taught about the reduction annealing and the possibility to obtain the low oxygen and carbon content in water-atomised iron powders including elements sensitive to oxidation, such as chromium, manganese. The only information given in this respect seems to be in example 1, which discloses that a final reduction has to be performed.

SUMMARY OF THE INVENTION

Figure 1:
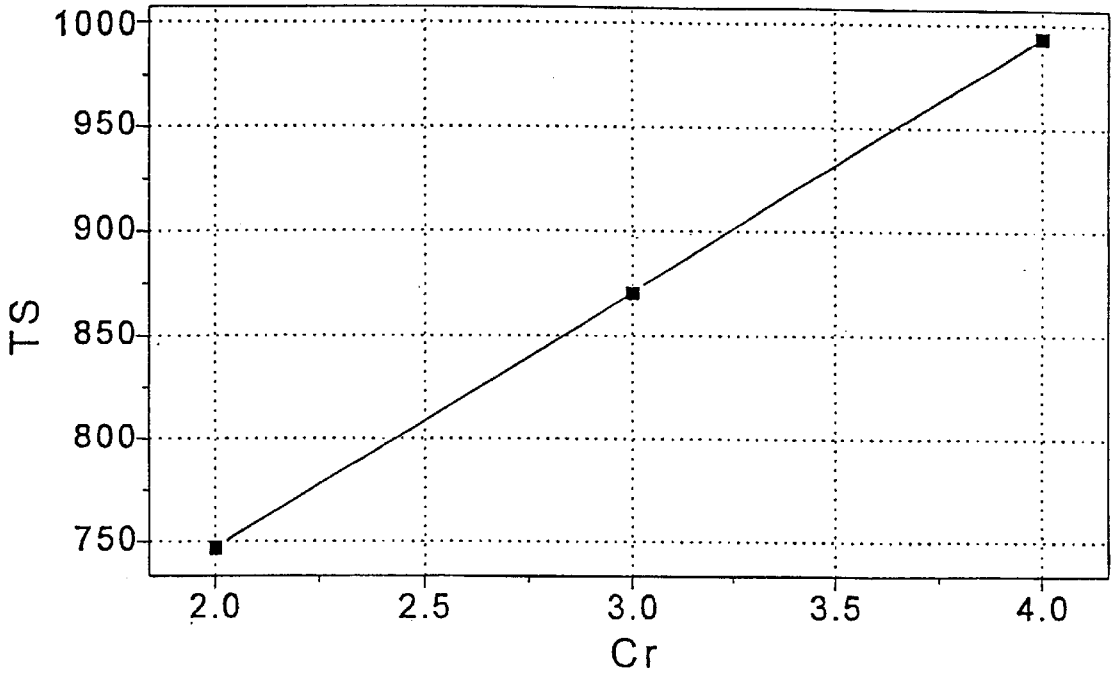
FIG. 1 shows the relationship between Cr and tensile strength.

In brief the present invention concerns a chromium-based low oxygen, low carbon iron powder including 2.5 to 3.5% by weight of chromium, 0.3 to 0.7% by weight of molybdenum and 0.09 to 0.3% by weight of manganese. This composition permits the production of sintered components having excellent mechanical properties from an inexpensive water-atomised and reduction annealed raw material.

Unexpectedly it has been found that sintered products prepared from the powder according to the invention are distinguished by a combination of high tensile strength, high toughness and high dimensional accuracy. Even more surprising is the fact that these properties can be obtained without thermal treatments of the sintered products. It has thus been found that sintered products combining a tensile strength of at least 800 MPa and an impact strength of at least 19 J can be obtained in cost effective sintering equipment, such as high output belt furnaces, operating at about 1120° C. with sintering times of about 30 minutes.

Preferably the amount of Cr varies between 2.7 and 3.3% by weight, the amount of Mo varies between 0.4 and 0.6% by weight and the amount of Mn varies between 0.09 and 0.3% by weight.

The alloy steel powder of the invention can be readily produced by subjecting ingot steel prepared to have the above-defined composition of alloying elements to any known water-atomising method. It is preferred that the water-atomised powder is prepared in such a way that, before annealing, the water-atomised powder has a weight ratio O:C between 1 and 4, preferably between 1.5 and 3.5 and most, preferably between 2 and 3, and a carbon content between 0.1 and 0.9% by weight. For the further processing according to the present invention this water-atomised powder could be annealed according to methods described in PCT/SE97/01292 (which is hereby incorporated by reference) and which more specifically concerns a process including the following steps a) preparing a water atomised powder essentially consisting of iron and optionally at least one alloying element selected from the group consisting of chromium, manganese, copper, nickel, vanadium, niobium, boron, silicon, molybdenum and tungsten.

b) annealing the powder in an atmosphere containing at least $H_2$ and $H_2O$ gases;

c) measuring the concentration of at least one of the carbon oxides formed during the decarburisation process; or d) measuring the oxygen potential essentially simultaneously in at least 2 points located at a predetermined distance from each other in the longitudinal direction of the furnace; or e) measuring the concentration according to c) in combination with measuring the oxygen potential in at least one point in the furnace f) adjusting the content of the $H_2O$ gas in the decarburising atmosphere with the aid of the measurement.

Another process which can be used for the preparation of low oxygen, low carbon iron-based powders including low amounts of easily oxidised alloying elements is disclosed in the co-pending Swedish application 9800153-0. This process includes the steps of charging a gas tight furnace with the water-atomised powder in an essentially inert gas atmosphere and closing the furnace;

increasing the furnace temperature, preferably by direct electrical or gas heating to a temperature of 800–1350° C.;

monitoring the increase of the formation of CO gas and evacuating gas from the furnace when a significant increase of the CO formation is observed; and cooling the powder when the increase of the formation of CO gas diminishes.

The annealed low oxygen, low carbon powder is then mixed with graphite powder and optionally at least one alloying element selected from the group Cu, P, B, Nb, V, Ni and W in an amount, which is determined by the final use of the sintered product. The amount of graphite added usually varies between 0.15 and 0.65% by weight of the iron-based powder, and a lubricant, such as zinc stearate or H-wax, in an amount up to 1% by weight of the iron-based powder. This mixture is then compacted at conventional compacting pressures, i.e. at pressures from 400–800 MPa, and sintered at temperatures between 1100 and 1300° C. Preferably and most unexpectedly, however, products prepared from the powder according to the invention exhibit excellent mechanical properties also when the powders are sintered at low temperatures, i.e. temperatures below about 1220° C., preferably below 1200° C. or even below about 1150° C., and comparatively short sintering times, i.e. sintering times below 1 h, such as 45. Usually the sintering time is about 30 minutes.

The reasons why the respective components in the alloy steel powder and sintered body of the invention are limited within certain ranges are as follows.

The reason why C in the alloy steel powder is not larger than 0.01% is that C is an element which serves to harden the ferrite matrix through formation of a solid solution as penetrated in the steel. If the C content exceeds 0.01% by weight, the powder is hardened considerably, which results in a too poor compressibility for a powder intended for commercial use.

The amount of C in the sintered product is determined by the amount of graphite powder mixed with the alloy steel powder of the invention. Typically the amount of graphite added to the powders is between 0.15 and 0.65% by weight. For powders having Cr contents between 3 and 3.5% the amount of graphite added is somewhat lower and preferably between 0.15 and 0.5%. The amount of C in the sintered product is essentially the same as the amount of graphite added to the powder.

The limited amounts of the following components are common to both the alloy steel powder and the sintered body.

The component Mn improves the strength of steel by improving hardenability and through solution hardening. However, if the amount of Mn exceeds 0.3%, the ferrite hardness will increase through solid solution hardening, and this, in turn, results in powders having poor compressibility. If the amount of Mn is less than 0.08 it is not possible to use cheap scrap that normally has an Mn content above 0.08% , unless a specific treatment for the reduction of Mn during the course of the steel manufacturing is carried out (cf EP 653 262 p.4, lines 42–44). Thus, the preferred amount of Mn according to the present invention is 0.09–0.3%. In combination with C contents below 0.007% this Mn interval gives the most interesting results.

Figure 2:
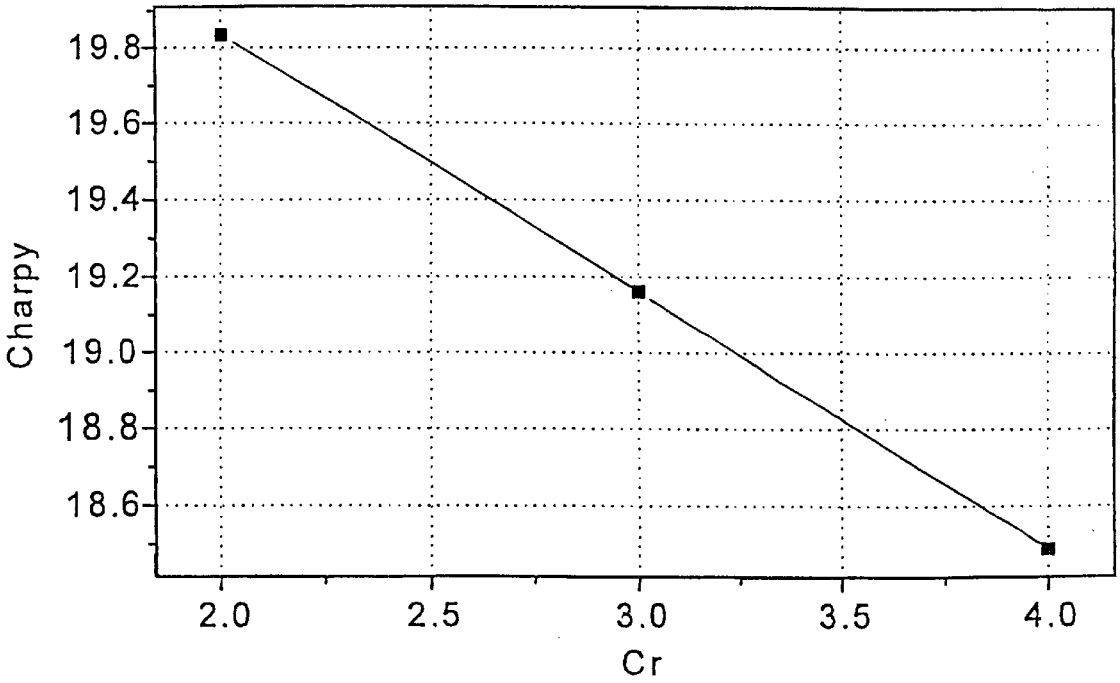
FIG. 2 shows the relationship between Cr and impact strength.

The component Cr is a suitable alloying element in steel powders, since it provides sintered products having an improved hardenability but not significantly increased ferrite hardness. To obtain a sufficient strength after sintering a Cr content of 2.5% or higher is preferred. Cr contents above 3.5% result in problems with oxide and/or carbide formation. Additionally the hardenability of becomes too high for practical applications of the sintered products if the Cr content exceeds 3.5% by weight. The criticality of selecting the narrow range of 2.5–3.5% of Cr for achieving a combination of high tensile and impact strength is furthermore disclosed on the enclosed FIGS. 1 and 2, respectively.

The component Mo serves to improve the strength of steel through the improvement of hardenability and also through solution and precipitation hardening. A Mo content below 0.3% has only negligible effect on the properties. Furthermore, it is preferred that the Mo amount should not exceed 0.7% due to the costs of this alloying element.

In general low amounts, i.e. amounts below 0.01, of S and P are required in order to obtain high strength sintered bodies and powders having high compressibility and the amounts of S and P in the powders used according to the present invention are below 0.01% by weight.

The component O has a large influence on the mechanical strength of the sintered body and generally it is preferred that the amount of O should be kept as low as possible. O forms stable oxides with Cr and this brings about that a proper sintering mechanism is prevented. The amount of O should therefor preferably not exceed 0.2%. If the amount exceeds 0.25%, large amounts of the oxides are generated.

The sintering of the compacted body is preferably carried out at a temperature lower than 1220° C., more preferably at temperatures below 1200° C. and most preferably at temperatures below 1150° C. As disclosed in the following examples unexpectedly good tensile strength without any subsequent heat treatment is obtained when sintering at temperatures as low as 1120° C. for periods of only 30 minutes. At high temperatures, i.e. temperatures above 1220° C. sintering costs undesirably increase which makes the powders and method according to the present invention very attractive from an industrial point of view.

A cooling rate below 0.5° C./s results in the formation of ferrite and cooling rates exceeding 2° C./s result in martensite formation. Depending on i.a. the composition of the iron powder and the amount of graphite added cooling rates typical for belt furnaces, i.e. 0.5–2° C./s lead to fully bainitic structures which is desirable for a good combination of strength and toughness. In this context it should also be mentioned that the sintering process according to the present invention is preferably carried out in belt furnaces.

The invention is further illustrated by the following examples.

EXAMPLE 1

Steel powders having Cr contents between 2 and 3% by weight, an Mo content of 0.5% by weight and an Mn content of 0.11% by weight were water-atomised and annealed as described in the patent application PCT/ SE 97/01292. Graphite (C-UF4) in amounts varying from 0.3 to 0.7% by weight was added as well as 0.8% by weight of a lubricant, H-wax. The powders were compacted at 700 MPa and then sintered in an atmosphere of 90% $N_2$/10$H_2$ for 30 minutes at 1120° C. The following tables 1, 2 and 3 disclose the green density (GD), the dimensional change (dl/L), the hardness (Hv10), the tensile strength (TS), the yield strength(YS) and the impact energy (Charpy) for the products prepared.

TABLE 1

| Powder: 2 Cr 0.5 Mo 0.11 Mn | | | | | | |
|---|---|---|---|---|---|---|
| Graphite added % | GD g/cc | dl/L | Hv10 | TS MPa | YS MPa | Charpy J |
| 0.3 | 7.14 | −0.072 | 200 | 669 | 521 | 23.5 |
| 0.4 | 7.11 | −0.085 | 210 | 720 | 538 | 20.8 |
| 0.5 | 7.12 | −0.072 | 221 | 761 | 576 | 21.2 |
| 0.6 | 7.10 | −0.056 | 237 | 808 | 612 | 18.6 |
| 0.7 | 7.12 | −0.025 | 261 | 861 | 698 | 16.8 |

TABLE 2

| Powder: 2.5 Cr 0.5 Mo 0.11 Mn | | | | | | |
|---|---|---|---|---|---|---|
| Graphite added % | GD g/cc | dl/L | Hv10 | TS MPa | YS MPa | Charpy J |
| 0.3 | 7.13 | −0.089 | 218 | 731 | 534 | 25.8 |
| 0.4 | 7.12 | −0.077 | 227 | 762 | 561 | 22.1 |
| 0.5 | 7.11 | −0.065 | 251 | 814 | 595 | 20.4 |
| 0.6 | 7.11 | −0.044 | 268 | 877 | 679 | 18.5 |
| 0.7 | 7.07 | −0.019 | 361 | 1007 | 732 | 16.1 |

TABLE 3

| Powder: 3 Cr 0.5 Mo 0.11 Mn | | | | | | |
|---|---|---|---|---|---|---|
| Graphite added % | GD g/cc | dl/L | Hv10 | TS MPa | YS MPa | Charpy J |
| 0.3 | 7.10 | −0.106 | 234 | 754 | 526 | 24.0 |
| 0.4 | 7.10 | −0.076 | 247 | 804 | 563 | 20.7 |
| 0.5 | 7.10 | −0.034 | 257 | 856 | 623 | 18.0 |
| 0.6 | 7.09 | −0.001 | 315 | 969 | 704 | 16.4 |
| 0.7 | 7.04 | | 508 | | 685 | 15.6 |

Example 2

A too high Mn content has a negative influence on compressibility due to increase of the ferrite hardness through solid solution hardening. This is illustrated in Table 4, which discloses the compressibility of Fe-3Cr-0.5Mo powder with lubricated die/at 600 MPa.

TABLE 4

| Powder | C [%] | O [%] | Mn [%] | GD [g/cc] |
|---|---|---|---|---|
| A | 0.003 | 0.12 | 0.09 | 7.00 |
| B | 0.004 | 0.14 | 0.12 | 6.98 |
| C | 0.004 | 0.13 | 0.18 | 6.90 |
| D | 0.004 | 0.13 | 0.28 | 6.81 |

What is claimed is:

1. A water-atomised, annealed iron-based powder comprising, by weight %,

Cr 2.5–3.5
Mo 0.3–0.7
Mn 0.09–0.3
Cu<0.10
Ni<0.15
P<0.02
N<0.01
V<0.10
Si<0.10
W<0.10
O<0.25
C<0.01 the balance being iron and, an amount of not more than 0.5%, inevitable impurities.

2. The water-atomised, annealed iron-based powder according to claim 1 comprising, by weight %, Cr 2.7–3.3
Mo 0.4–0.6
Mn 0.09–0.25
O<0.15
C<0.007 the balance being iron and, an amount of not more that 0.2%, inevitable impurities.

3. Method of preparing a sintered product having a tensile strength of at least 750 MPa without subsequent heat treatment comprising the steps of water-atomising an iron-based powder comprising the alloying elements Cr, Mo and Mn in the amounts according to claim 1;

annealing the water-atomised powder;

adding graphite and optionally at least one alloying element selected from the group Cu, P, B. Nb, V, Ni and W in an amount, which is determined by the final use of the sintered product;

compacting the annealed powder at a pressure of at least 600 MPa;

and subjecting the compacted body to sintering.

4. Method according to claim 3 wherein the reduction is performed at atmospheric pressure in a reducing atmosphere in the presence of $H_2$ and controlled amounts of $H_2O$.

5. Method according to claim 3 wherein the reduction is performed at low pressure in an essentially inert atmosphere and CO evacuation.

6. The method according to claim 3, wherein the water-atomised powder before annealing has a weight ratio O:C between 1 and 4 and a carbon content between 0.1 and 0.9% by weight.

7. The method according to claim 3 wherein graphite in an amount of 0.25 to 0.65% by weight, is added to the powder before the compacting step.

8. The method according to claim 3 wherein for powders having a Cr content of 3–3.5 the amount of graphite is 0.25 to 0.5% by weight.

9. The method according to claim 3 wherein the sintering temperature is at most 1220° C.

10. The method according to claim 3 wherein the sintering times are less than 60 minutes.

11. A sintered product prepared according to claim 3 having a combined carbon content of at least 0.25%.

12. Method of preparing a sintered product having a tensile strength of at least 750 MPa without subsequent heat treatment comprising the steps of water-atomising an iron-based powder comprising the alloying elements Cr, Mo and Mn in the amounts according to claim 2;

annealing the water-atomised powder;

adding graphite and optionally at least one alloying element selected from the group Cu, P, B Nb, V, Ni and W in an amount, which is determined by the final use of the sintered product;

compacting the annealed powder at a pressure of at least 600 MPa;

and subjecting the compacted body to sintering.

13. The method according to claim 4, wherein the water-atomised powder before annealing has a weight ratio O:C between 1 and 4 and a carbon content between 0.1 and 0.9% by weight.

14. The method according to claim 5, wherein the water-atomised powder before annealing has a weight ratio O:C between 1 and 4 and a carbon content between 0.1 and 0.9% by weight.

15. The method according to claim 4, wherein graphite in an amount of 0.25 to 0.65% by weight, is added to the powder before the compacting step.

16. The method according to claim 5, wherein graphite in an amount of 0.25 to 0.65% by weight, is added to the powder before the compacting step.

17. The method according to claim 6, wherein graphite in an amount of 0.25 to 0.65% by weight, is added to the powder before the compacting step.

18. The method according to claim 4, wherein for powders having a Cr content of 3–3.5 the amount of graphite is 0.25 to 0.5% by weight.

19. The method according to claim 5, wherein for powders having a Cr content of 3–3.5 the amount of graphite is 0.25 to 0.5% by weight.

20. A sintered product prepared according to claim 6, having a combined carbon content of at least 0.25%.

21. The method according to claim 3, wherein the water-atomised powder before annealing has a weight ratio O:C between 1.5 and 3.5 and a carbon content between 0.1 and 0.9% by weight.

22. The method according to claim 3, wherein the water-atomised powder before annealing has a weight ratio O:C between 2 and 3 and a carbon content between 0.1 and 0.9% by weight.

23. The method according to claim 3 wherein graphite in an amount of 0.3 to 0.5% by weight, is added to the powder before the compacting step.

24. The method according to claim 3 wherein the sintering temperature is at most 1200° C.

25. The method according to claim 3 wherein the sintering temperature is at most 1150° C.

26. A sintered product prepared according to claim 3 having a combined carbon content of at least 0.3%.

27. A sintered product prepared according to claim 3 having a fully bainitic structure, a tensile strength of at least 800 MPa and an impact strength of at least 19 Joules.

28. A sintered product prepared according to claim 3 having a fully bainitic structure, a Mn content of 0.09 to 0.25%, a tensile strength of at least 800 MPa and an impact strength of at least 19 Joules.

29. The water-atomised, annealed iron-based powder according to claim 1, having a sulfur content below 0.01% by weight.

30. The water-atomised, annealed iron-based powder according to claim 1, having a sulfur content below 0.01% by weight and a phosphorus content below 0.01% by weight.

* * * * *